US008158318B2

(12) United States Patent
Kim

(10) Patent No.: US 8,158,318 B2
(45) Date of Patent: Apr. 17, 2012

(54) MULTICOLOR IMAGE FORMING APPARATUS AND IMAGE FORMING METHOD THEREOF

(75) Inventor: Tae-hyun Kim, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 527 days.

(21) Appl. No.: 12/432,941

(22) Filed: Apr. 30, 2009

(65) Prior Publication Data

US 2010/0062353 A1 Mar. 11, 2010

(30) Foreign Application Priority Data

Sep. 9, 2008 (KR) ..... 2008-88841

(51) Int. Cl.
*G03G 9/087* (2006.01)

(52) U.S. Cl. ..... 430/109.1; 430/109.3; 430/109.31; 430/109.4; 399/121; 399/297

(58) Field of Classification Search ..... 430/109.1, 430/109.3, 109.31, 109.4; 399/121, 297
See application file for complete search history.

(56) References Cited

U.S. PATENT DOCUMENTS 6,586,147 B2 * 7/2003 Iida et al. ..... 430/45.5
2005/0100808 A1 * 5/2005 Hashimoto et al. ..... 430/108.8

* cited by examiner

*Primary Examiner* — Hoa V Le
(74) *Attorney, Agent, or Firm* — Stanzione & Kim, LLP

(57) ABSTRACT

A multicolor image forming apparatus which includes a developer image forming unit to form an image using a developer and a transferring unit to transfer the formed developer image to a recording medium, wherein the developer comprises a plurality of dark developers and one or more light developers, wherein the dark developers and the light developers each include a binder resin having a weight average molecular weight from about 50,000 Mw to about 160,000 Mw, and wherein about 50,000 Mw to about 160,000 Mw of the weight average molecular weight of the binder resin of the dark developer is larger than about 50,000 Mw to about 160,000 Mw of the weight average molecular weight of the binder resin of the light developer.

10 Claims, 2 Drawing Sheets

MULTICOLOR IMAGE FORMING APPARATUS AND IMAGE FORMING METHOD THEREOF

CROSS-REFERENCE TO RELATED APPLICATIONS

This application claims priority under 35 U.S.C. §119(a) from Korean Patent Application No. 2008-0088841, filed on Sep. 9, 2008, in the Korean Intellectual Property Office, the disclosure of which is incorporated herein in its entirety by reference.

BACKGROUND

1. Field of the Invention

The present general inventive concept relates to an image forming apparatus to form multicolor images using an electro-photographic technique and an image forming method thereof, and more particularly, to a multicolor image forming apparatus in which image degradation caused by developer stress is reduced and thus a life span of the image forming apparatus is increased, and an image forming method thereof.

2. Description of the Related Art

Image forming apparatuses using an electro-photographic technique, for example printers, copy machines, fax machines, or multifunction peripheral (MFP), include a photoconductive medium, an exposure device to scan a laser beam toward the photoconductive medium and to form an electrostatic latent image according to image data, a developing device to supply a developer to the photoconductive medium on which the electrostatic latent image is formed and to develop the electrostatic latent image, and a transferring device to transfer the developed latent image.

There is demand for image forming apparatuses which use an electro-photographic technique, such as printers or copy machines, to have a full-color offering function in order to satisfy various requirements of users. With the development of digital technology, image forming apparatuses using an electro-photographic technique, for example printers, copy machines, or multifunction peripherals, have ensured high quality, and have improved performance so as to satisfy a requirement for properties such as high resolution, excellent color reproducibility, wide color reproduction range, high clarity, and/or proper color gradation.

Multicolor image forming apparatuses which are used to form various colors include dark developers such as yellow, magenta, cyan, and black dark developers, and light developers such as magenta and cyan light developers as developers or toners which are generally used in an image forming unit.

Image forming apparatuses using an electro-photographic technique form color images using developers or toners of four basic colors, such as yellow, magenta, cyan, and black. However, such image forming apparatuses have limitations concerning a resolution, color reproducibility, color clarity, and color gradation of images produced thereby, since it is difficult for particles of a developer or a toner to be uniformly and stably attached to dots formed at regular intervals. In addition, the color gradation corresponding to a ratio of dot density of dots having the developer or the toner disposed thereon to the dot density of dots which do not have the developer or the toner disposed thereon is poor.

Image forming apparatuses using an electro-photographic technique may be effective in printing documents which include text, but it is ineffective for image forming apparatuses which are used to print photos or pictures that require a high resolution, excellent color reproducibility, high clarity, and proper color gradation.

Image forming apparatuses such as an inkjet printer use liquid developers or toners which have approximately 11 or 12 colors, and thus generate an image superior to that of a laser printer in resolution, color reproducibility, clarity, and color gradation.

Multicolor image forming apparatuses consume more light developers than dark developers, and thus the dark developers suffer from greater stress than the light developers, which results in image degradation. The image degradation causes an image to be blurred or causes white stripes to appear.

The image degradation caused by the dark developer makes it impossible for an image forming apparatus to be used for a long period of time.

Therefore, there is a need for image forming apparatuses which may be used for a long period of time without having image degradation.

SUMMARY

The present general inventive concept provides a multicolor image forming apparatus which prevents image degradation which is caused by toner stress, and thus may be used for a longer period of time.

The present general inventive concept also provides a method for forming a multicolor image without having image degradation being caused by the toner stress.

Additional features and utilities of the present general inventive concept will be set forth in part in the description which follows and, in part, will be obvious from the description, or may be learned by practice of the general inventive concept.

Embodiments of the present general inventive concept provide a multicolor image forming apparatus which includes a developer image forming unit to form a developer image using a developer, and a transferring unit to transfer the formed developer image to a recording medium, wherein the developer includes a plurality of dark developers and one or more light developers, wherein the dark developers and the light developers each include a binder resin having a weight average molecular weight from about 50,000 Mw to about 160,000 Mw, and wherein about 50,000 Mw to about 160,000 Mw of the weight average molecular weight of the binder resin of the dark developer is larger than about 50,000 Mw to about 160,000 Mw of the weight average molecular weight of the binder resin of the light developer.

The binder resin of the dark developer may have the weight average molecular weight from about 100,000 Mw to about 160,000 Mw, and the binder resin of the light developer may have the weight average molecular weight from about 50,000 Mw to about 100,000 Mw.

The dark developer and the light developer may each include a binder resin having a weight average molecular weight equal to or larger than about 5,000 Mw and less than about 10,000 Mw.

The binder resin of the developers may include one selected from the group consisting of polystyrene resin, polyvinyltoluene resin, polyethylene resin, polypropylene resin, polyacrylate resin, polymethacrylate resin, polyester resin, and polyacrylonitrile resin, or a combination of two or more these.

If the dark developer includes a magenta developer and a cyan developer, the light developer may include one or more developers among a magenta light developer, a cyan light developer, a yellow light developer, a black light developer, a transparent developer, and a white developer.

Embodiments of the present general inventive concept may also provide a method for forming a multicolor image which includes forming a developer image using a developer including a plurality of dark developers and one or more light developer, and transferring the formed developer image to a recording medium, wherein the dark developers and the light developers each include a binder resin having a weight average molecular weight from about 50,000 Mw to about 160,000 Mw, and wherein about 50,000 Mw to about 160,000 Mw of the weight average molecular weight of the binder resin of the dark developer may be greater than about 50,000 Mw to about 160,000 Mw of the weight average molecular weight of the binder resin of the light developer.

The binder resin of the dark developer may have the weight average molecular weight from about 100,000 Mw to about 160,000 Mw, and the binder resin of the light developer may have the weight average molecular weight from about 50,000 Mw to about 100,000 Mw.

The dark developer and the light developer may each include a binder resin having a weight average molecular weight equal to or greater than 5,000 Mw and less than 10,000 Mw.

The binder resin of the developers may include one selected from the group consisting of polystyrene resin, polyvinyltoluene resin, polyethylene resin, polypropylene resin, polyacrylate resin, polymethacrylate resin, polyester resin, and polyacrylonitrile resin, or a combination of two or more these.

If the dark developer includes a magenta developer and a cyan developer, the light developer may include one or more among a magenta light developer, a cyan light developer, a yellow light developer, a black light developer, a transparent developer, and a white developer.

Embodiments of the present general inventive concept may also provide a developer image forming unit usable with an image forming unit, the developer image forming unit including a plurality of dark developers and at least one light developer disposed within the developer image forming unit, a first binder corresponding to at least one dark developer, and a second binder corresponding to at least one light developer, wherein a weight average molecular weight of the first binder resin is larger than that of the second binder resin. The first and second binder resin may have a binder resin having a weight average molecular weight ranging from about 50,000 Mw to about 160,000 Mw, and wherein about 50,000 Mw to about 160,000 Mw of the weight average molecular weight of the first binder resin may be larger than about 50,000 Mw to about 160,000 Mw of the weight average molecular weight of the second binder resin.

The first and second binder resin have a binder resin having a weight average molecular weight larger than or equal to about 5,000 Mw and equal to or less than about 10,000 Mw.

At least one of the first and second binder resin may include one selected from the group consisting of polystyrene resin, polyvinyltoluene resin, polyethylene resin, polypropylene resin, polyacrylate resin, polymethacrylate resin, polyester resin, and polyacrylonitrile resin, or a combination of two or more these.

Embodiments of the present general inventive concept may also provide developer usable with an image forming unit, the developer including a plurality of dark developers and at least one light developer, a first binder corresponding to at least one dark developer, and a second binder corresponding to at least one light developer, wherein a weight average molecular weight of the first binder resin may be larger than that of the second binder resin.

The first and second binder resin may have a binder resin having a weight average molecular weight ranging from about 50,000 Mw to about 160,000 Mw, and wherein about 50,000 Mw to about 160,000 Mw of the weight average molecular weight of the first binder resin is larger than about 50,000 Mw to about 160,000 Mw of the weight average molecular weight of the second binder resin.

The first and second binder resin have a binder resin having weight average molecular weight larger than or equal to about 5,000 Mw and equal to or less than about 10,000 Mw.

At least one of the first and second binder resin may include one selected from the group consisting of polystyrene resin, polyvinyltoluene resin, polyethylene resin, polypropylene resin, polyacrylate resin, polymethacrylate resin, polyester resin, and polyacrylonitrile resin, or a combination of two or more these.

BRIEF DESCRIPTION OF THE DRAWINGS

These and/or other features and utilities of the present general inventive concept will become apparent and more readily appreciated from the following description of the exemplary embodiments, taken in conjunction with the accompanying drawings of which.

DETAILED DESCRIPTION OF THE EMBODIMENTS

Figure 1:
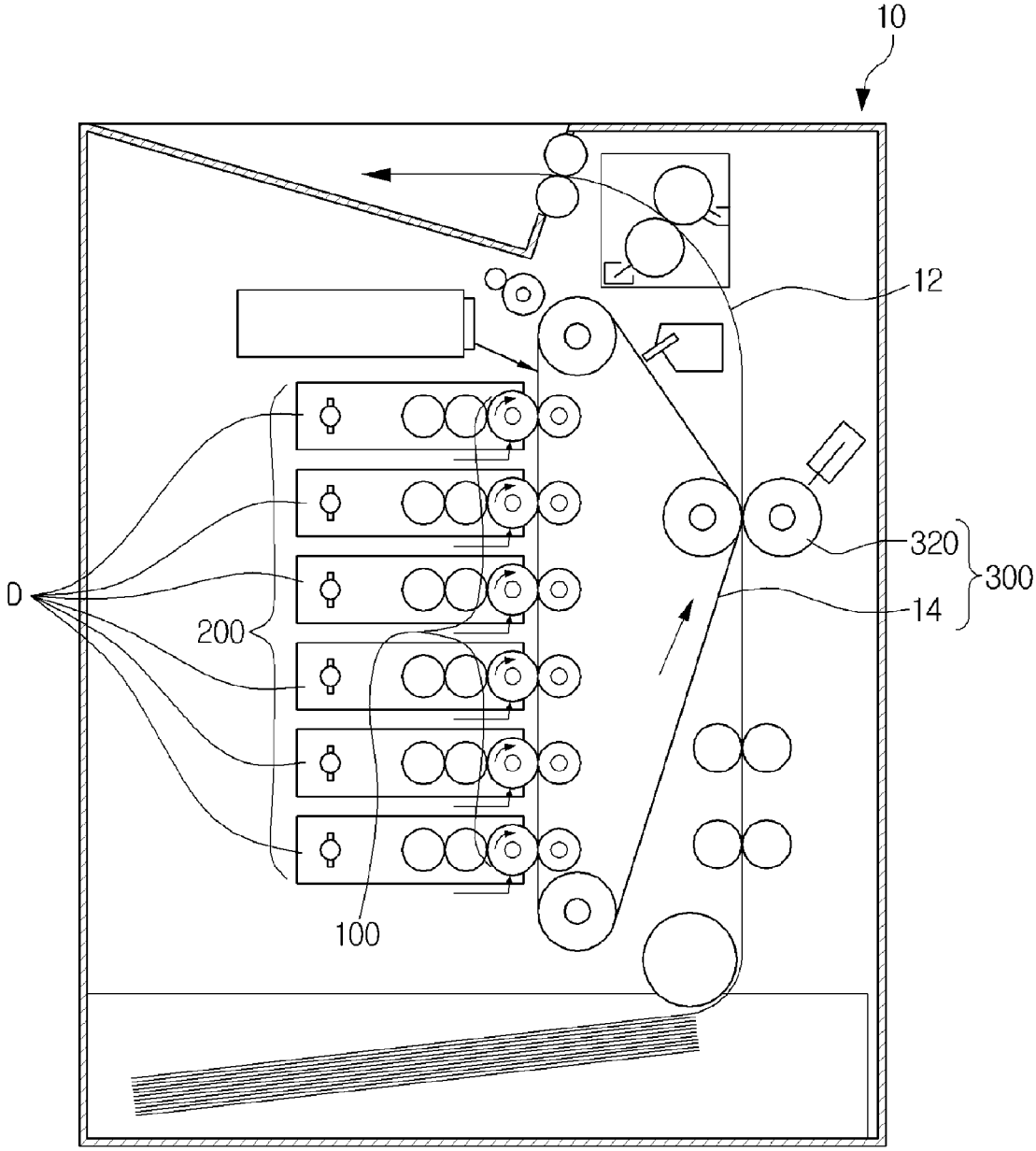
FIG. 1 illustrates a cross-sectional view of a multicolor image forming apparatus using a single path according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Features and/or utilities of the present general inventive concept will be explained in detail with reference to the drawings and the exemplary embodiments.

A multicolor image forming apparatus according to an exemplary embodiment of the present general inventive concept includes a developer image forming unit which is used to form an image by using a developer and a transferring unit to transfer the formed image to a recording medium. The developer may include a plurality of dark developers and one or more light developers. The dark developers and light developers may each include a binder resin having a weight average molecular weight from about 50,000 Mw to about 160,000 Mw. The weight average molecular weight of the binder resin of the dark developer may be greater than that of the light developer. However, the present general inventive concept is not limited thereto. That is, in exemplary embodiments, the dark developer may include a first binder resin and the light developer may include a second binder resin. In an exemplary embodiment, the first binder resin may be different than the second binder resin.

Figure 2:
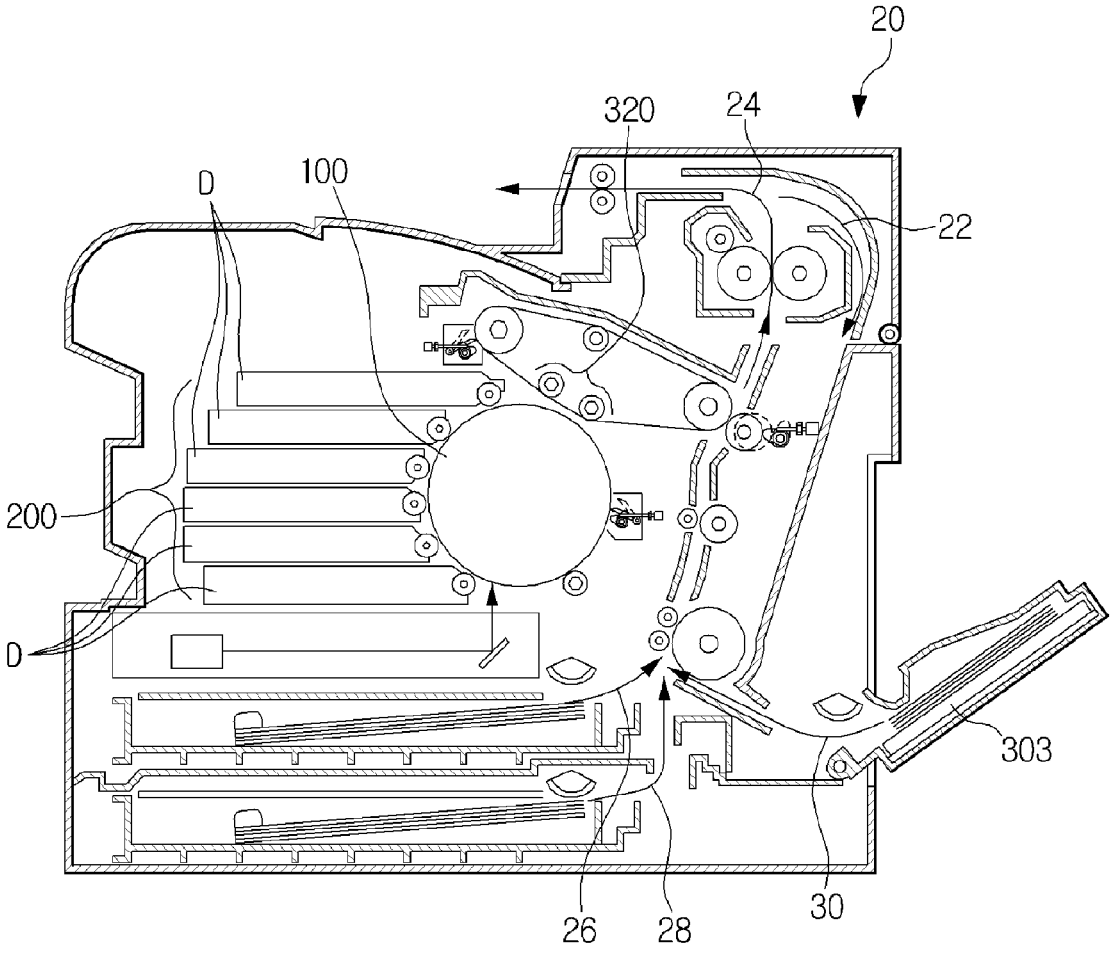
FIG. 2 illustrates a cross-sectional view of a multicolor image forming apparatus using multiple paths according to another exemplary embodiment of the present general inventive concept.

A multicolor image forming apparatus 10 according to an exemplary embodiment of the present general inventive concept will be explained with reference to FIGS. 1 and 2. FIG. 1 is a cross-sectional view illustrating a multicolor image forming apparatus 10 using a single path 12 according to an exemplary embodiment of the present general inventive concept, and FIG. 2 is a cross-sectional view illustrating a multicolor image forming apparatus 20 using multiple paths 22, 24, 26, 28, and 30 according to an exemplary embodiment of the present general inventive concept. Common or like elements in the drawings are marked with the same reference numerals.

Referring to FIG. 1, developers for each color, developer supply devices 200, and a plurality of organic photoconductive (OPC) units 100 which are used to form an image by using the developers D are provided. A multicolor image forming apparatus 10 having a single path 12 may form a latent image having developers of required colors while a transferring belt 14 rotates. In an exemplary embodiment, the latent image, which includes the developers of all of the required colors, is formed while the transferring belt 14 makes a single rotation.

Referring now to FIG. 2, a multicolor image forming apparatus 20 according to another exemplary embodiment includes a single OPC unit 100, wherein the OPC unit 100 rotates as many times as there are required colors so as to form a latent image having developers D of the required colors. That is, in an exemplary embodiment, if the latent image requires twelve developers, then the OPC unit 100 would rotate twelve times in order to form the latent image having all of the developers of the required colors. However, the present general inventive concept is not limited thereto. In an alternative exemplary embodiment, a number of required developers may be disposed onto the OPC unit 100 in fewer rotations than the number of required developers. For instance, if the required number of developers is twelve, the OPC unit 100 would rotate four times in order to have all of the required developers disposed thereon.

The multicolor image forming apparatus according to an exemplary embodiment of the present general inventive concept includes one or more image forming units for each developer D, and thus the image forming apparatus may employ either a single path or a multiple path configuration.

The transferring unit 300 includes a transferring roller 320 and a transferring belt 14. However, the present general inventive concept is not limited thereto. That is, in exemplary embodiments, the transferring unit 300 may include a transferring means commonly used in multicolor image forming apparatuses.

A dark developer and a light developer are used in the current exemplary embodiment of the present general inventive concept. The light developer refers to a developer having a same color as the dark developer but being lighter in weight as compared to that of the dark developer. However, the present general inventive concept is not limited thereto. That is, in exemplary embodiments, the light developer may refer to a transparent developer or a white developer.

In exemplary embodiments, the developer D may be classified as a two-component developer D formed of toner and carrier particles, or a one-component developer D formed of toner only. In yet further exemplary embodiments, the developer D may include a mixture of, for example, a non-magnetic toner and a magnetic toner.

In the current exemplary embodiment of the present general inventive concept, when a developer image is formed on a transferring member, such as a transferring belt, has a color density of about 0.6 mg/cm2, the color density of the dark developer may be equal to or greater than about 1.0, and the color density of the light developer in the same conditions may be less than about 0.8.

In exemplary embodiments, developers D may be classified as pulverized developers or polymerized developers according to the manufacturing process used.

Pulverized developers include coloring agents, charge control agents, and other additives. The additives may be classified as internal additives, which are incorporated into the interior of developer particles, and external additives, which are attached to the external surface of developer particles. Such additives may be added to the developer particles in order to improve a performance of the developer used in the image forming apparatus. The developers are produced by generating developer particles including a coloring agent, a charge control agent, and internal additives, pulverizing the generated developer particles so that developer particles having a specific particle diameter is manufactured, and attaching external additives to the developer particles, as necessary.

The polymerized developer using the emulsion polymerization is produced by binding a binder resin, a coloring agent, and a release agent using a flocculant, forming a core, forming a shell around the core by processes of cohesion and fusion, and then producing developer particles.

The dark developer and the light developer used in the current exemplary embodiment of the present general inventive concept may be used irrespective of whether a pulverized developer or a polymerized developer is used.

When the pulverized developer and the polymerized developer are manufactured, the coloring agent which is used to develop colors on a printing image may be a dye-based or a pigment-based coloring agent. However, the present general inventive concept is not limited thereto. That is, in exemplary embodiments, a dye-based coloring agent having excellent heat resistance and lightfastness may also be used.

The coloring agents in the current exemplary embodiment may include, but is not limited to, at least one selected from the group consisting of azo dyes, phthalocyanine dyes, basic pigment dyes, quinacridone dyes, dioxazine dyes, condensation azo dyes, carbon black, chromate, ferrocyanide, oxide, selenium sulfide, sulfate, silicate, carbonate, phosphate, and metallic powder or a combination of two or more these. However, the present general inventive concept is not limited thereto.

Such coloring agents may be used as developers according to the color derived from the coloring agent. In exemplary embodiments, the dark developer may include cyan, magenta, yellow, and black developers. However, the present general inventive concept is not limited thereto.

In exemplary embodiments, if cyan, magenta, yellow, and black developers are used as dark developers, developers having the same colors such as cyan, magenta, yellow, and black may be used as light developer. However, the present general inventive concept is not limited thereto. That is, in alternative exemplary embodiments, if cyan, magenta, yellow, and black developers are used as dark developers, a transparent or white developer may be used as a light developer.

Referring to FIGS. 1 and 2, six developers are illustrated in the drawings. However, the number of developers for each color is not limited, and an arrangement of dark and light developers are also not limited.

In exemplary embodiments, the binder resin may be a polymer resin, and may be a blend with a polymer resin having a low molecular weight and a polymer resin having a high molecular weight, as occasion demands.

The blending ratio of a polymer resin having a low molecular weight to a polymer resin having a high molecular weight may be appropriately set by taking into consideration a fixability or a transferability of the developer in which a binder resin is used. The blending ratio may be varied according to whether the developer is a pulverized developer or a polymerized developer, or according to the operating condition of the image forming apparatus. That is, in exemplary embodiments, the blending ratio may be varied in order to exhibit an optimal fixability and transferability of the developer according to operating conditions, such as the heat and pressure applied to the printing image.

The dark developer and the light developer used in this exemplary embodiment of the present general inventive concept may include a polymer resin having a high weight average molecular weight from about 50,000 Mw to about 160,000 Mw a as a binder resin. The weight average molecular weight of a binder resin of the dark developer may be larger than that used in a light developer.

When a developer is used in an image forming apparatus, specific physical energy, such as heat or pressure, is applied to the developer. In this situation, it is important to select an appropriate combination of the developer in order to achieve a clear image and also to exhibit excellent fixability and transferability to a recording medium.

A high polymer substance, such as a binder resin, is dissolved or deformed by heat or pressure. Therefore, the image forming apparatus according to the current exemplary embodiment of the present general inventive concept sets the binder resins of a dark developer and a light developer to have different weight average molecular weights, so that performance characteristics of a developer is achieved.

In the current exemplary embodiment of the present general inventive concept, the binder resin contained in the dark developer may have the weight average molecular weight from about 100,000 Mw to about 160,000 Mw, and the binder resin contained in the light developer may have the weight average molecular weight from about 50,000 Mw to about 100,000 Mw.

In exemplary embodiments, the dark developer and light developer may further include a polymer resin having a low molecular weight as a binder resin. The weight average molecular weight of the binder resin having a low molecular weight may be larger than or equal to about 5,000 Mw and equal to or less than about 10,000 Mw.

The binder resin which is to be used in the developer may be one selected from the group consisting of polystyrene resin, polyvinyltoluene resin, polyethylene resin, polypropylene resin, polyacrylate resin, polymethacrylate resin, polyester resin, and polyacrylonitrile resin, or a combination of two or more these. However, the binder resin used in the current exemplary embodiment of the present general inventive concept should not be considered limited thereto, and any resin which satisfies the above weight average molecular weight requirements may also be used in the current exemplary embodiment of the present general inventive concept.

The resin having a low molecular weight may be identical to or different from a resin having a high molecular. In an exemplary embodiment, a polyester resin is produced with a low molecular weight or a high molecular weight according to the polymerization degree within the molecule. The type of resin does not have a limitation when it is determined whether the resin is a low molecular weight resin or a high molecular weight resin. A resin having a low molecular weight or a high molecular weight may need to have excellent miscibility or compatibility.

According to an exemplary embodiment of the present general inventive concept, the multicolor image forming apparatus forms an image using developers of four basic colors such as yellow, magenta, cyan and black, light developers, and/or supplementary developer such as white and transparent developers, and thus the image may have a high resolution, excellent color reproducibility, wide color reproduction range, high clarity, and proper color gradation.

The image forming apparatus according to an exemplary embodiment of the present general inventive concept uses magenta and cyan light developers and white and transparent developers in addition to the yellow, magenta, cyan, and black developers. Accordingly, the image forming apparatus may produce a photographic image having a high resolution, excellent color reproducibility, wide color reproduction range, high clarity, and/or proper color gradation.

The multicolor image forming apparatus of FIG. 1 includes a developer storage unit (not illustrated in detail) and/or a waste developer storage unit (not illustrated in detail) of a black developer which are larger than those of the other developers, since the black developer is used more than the other developers. A detailed description thereof is provided below.

Since the developers for each color differ in color, brightness, and saturation, at least part of the base resin and additives such as the internal and external additives are applied differently for each developer. For example, as coloring agent to represent color is applied differently, a charge control agent such as silica of a different type or a different ratio is used to adjust the charge amount according to the amount and the type of coloring agent used. Accordingly, an amount of developer used to embody a single dot differs for each color, and also differs according to an image to be printed.

The amount of developer used differs for each color when a multicolor developing method using five or more colors is used, instead of a developing method using four basic colors. If the magenta light developer and/or the cyan light developer are used in addition to the basic four colors, light developers are used more than the other developers in order to achieve a smooth photographic image.

When the white or transparent developer is used in addition to the four basic colors, the white developer is used to make the four basic colors lighter, and the white developer is also generally used to print a specific pattern on an area outside the area on which the four basic colors are applied, or create a special effect on a surface of the printing medium, for example, give a feel of material and luster or decontaminate the surface of the printing medium. The transparent developer may be used for the same purpose as the white developer and also may be used to preserve the image by being coated over the image on which the four basic colors are applied. Such white and transparent developers are used much more than the four basic colors when general images are printed.

In the multicolor image forming method, supplementary developers such as light developers, and white and transparent developers are used much more than the four basic color developers.

Hereinbelow, an exemplary embodiment of the present general inventive concept will be explained in more detail.

EXAMPLES

A method for measuring physical properties of a developer which is manufactured according to exemplary embodiments and comparative examples of the present general inventive concept is explained below.

(1) Measurement of Glass Transition Temperature (Tg)

The glass transition temperature (Tg) is measured using a Differential Scanning Calorimeter (DSC). A sample is heated from room temperature to 200° C. at a temperature increasing rate of 10° C./min. The glass transition temperature (Tg) can be observed only in a non-crystalline region, and most polyester may be semi-crystalline resins having both non-crystalline resins and crystalline resins.

(2) Measurement of the Particle Diameter of a Developer

The particle diameter of a developer is measured using Multisizer 3 produced by a Beckman Coulter.

A sample is produced by filling a vial container with one-third distilled water, adding one or two drops of dispersant, and blending 10 mg of developers which will be prepared according to the following examples and comparative examples.

Polyoxyethylene lauryl ether of 5% by weight is used as a dispersant, and approximately 30000 particles are measured to determine a volume average particle diameter (D50).

(3) Measurement of Weight Average Molecular Weight of a Binder Resin

The weight average molecular weight is measured using Tetrahydrofuran (THF) (HPLC grade) as a reagent and using a Waters GPC system (515 HPLC pump/717 plus auto sampler) and a detector (refractive index/multi-angle light scattering) as an instrument.

A sample is prepared in which 50 to 60 mg of a sample is dissolved in 20 ml of THF to reach 3000 to 3500 ppm, and the sample is filtered using a syringe filter of a gel permeation chromatography (GPC) vial.

The measurement is performed under an HPLC condition satisfying 100% of THF as solvent, a flowing rate of 1 ml/min, a stationary time of 45 minutes, and an injection volume of 100 μl.

Example 1

A dark developer is produced using a binder resin having a low molecular weight of about 8,600 Mw and a binder resin having a high molecular weight of about 105,000 Mw following a general pulverization process.

A light developer is produced using a binder resin having a low molecular weight of about 8,600 Mw and a binder resin having a high molecular weight of about 84,000 Mw following a general pulverization process.

The yellow, magenta, cyan, and black colors are prepared and the magenta and cyan light developers are prepared.

The average particle diameter of the developers is about 7.5 μm.

Example 2

A dark developer and a light developer are produced in a manner the same as those of Example 1, but distinct from Example 1 in that the dark developer is produced using a binder resin having a low molecular weight of about 8,400 Mw and a binder resin having a high molecular weight of about 150,000 Mw, and the light developer is produced using a binder resin having a low molecular weight of about 8,600 Mw and a binder resin having a high molecular weight of about 86,000 Mw.

The developers have the average particle diameter of about 7.5 μm.

Comparative Example 1

A dark developer and a light developer are produced in a manner the same as those of Example 1, but distinct from Example 1 in that the dark developer is produced using a binder resin having a low molecular weight of about 8,500 Mw and a binder resin having a high molecular weight of about 98,000 Mw, and the light developer is produced using a binder resin having a low molecular weight of about 8,700 Mw and a binder resin having a high molecular weight of about 46,000 Mw.

The developers have the average particle diameter of about 7.4 μm.

Comparative Example 2

A dark developer and a light developer are produced in a manner the same as those of Example 1, but distinct from Example 1 in that the dark developer is produced using a binder resin having a low molecular weight of about 8,800 Mw and a binder resin having a high molecular weight of about 170,000 Mw, and the light developer is produced using a binder resin having a low molecular weight of about 8,500 Mw and a binder resin having a high molecular weight of about 88,000 Mw.

The developers have the average particle diameter of about 7.7 μm.

Comparative Example 3

A dark developer and a light developer are produced in a manner the same as those of Example 1, but distinct from Example 1 in that the dark developer is produced using a binder resin having a low molecular weight of about 8,500 Mw and a binder resin having a high molecular weight of about 85,000 Mw, and the light developer is produced using a binder resin having a low molecular weight of about 8,700 Mw and a binder resin having a high molecular weight of about 101,000 Mw.

The developers have the average particle diameter of about 7.4 μm.

Comparative Example 4

A dark developer and a light developer are produced in a manner the same as those of Example 1, but distinct from Example 1 in that the dark developer is produced using a binder resin having a low molecular weight of about 8,400 Mw and a binder resin having a high molecular weight of about 110,000 Mw, and the light developer is produced using a binder resin having a low molecular weight of about 8,600 Mw and a binder resin having a high molecular weight of about 104,000 Mw.

The developers have the average particle diameter of about 7.5 μm.

Comparative Example 5

A dark developer and a light developer are produced in a manner the same as those of Example 1, but distinct from Example 1 in that the dark developer is produced using a binder resin having a low molecular weight of about 8,600 Mw and a binder resin having a high molecular weight of about 47,000 Mw, and the light developer is produced using a binder resin having a low molecular weight of about 9,100 Mw and a binder resin having a high molecular weight of about 45,000 Mw.

The developers have the average particle diameter of about 7.3 μm.

Comparative Example 6

A dark developer and a light developer are produced in a manner the same as those of Example 1, but distinct from Example 1 in that the dark developer is produced using a binder resin having a low molecular weight of about 8,600

Mw and a binder resin having a high molecular weight of about 86,000 Mw, and the light developer is produced using a binder resin having a low molecular weight of about 9,100 Mw and a binder resin having a high molecular weight of about 87,000 Mw.

The developers have the average particle diameter of about 7.4 μm.

The developers manufactured according to the above examples and comparative examples are summarized in Table 1.

TABLE 1

| | Average particle diameter (μm) | Weight average molecular weight (Mw) of binder resin of dark developer | | Weight average molecular weight (Mw) of binder resin of light developer | |
|---|---|---|---|---|---|
| | | Binder resin having low molecular weight | Binder resin having high molecular weight | Binder resin having low molecular weight | Binder resin having high molecular weight |
| Example 1 | 7.5 | 8,600 | 105,000 | 8,600 | 84,000 |
| Example 2 | 7.5 | 8,400 | 150,000 | 8,600 | 86,000 |
| Comparative Example 1 | 7.4 | 8,500 | 98,000 | 8,700 | 46,000 |
| Comparative Example 2 | 7.7 | 8,800 | 170,000 | 8,500 | 88,000 |
| Comparative Example 3 | 7.4 | 8,500 | 85,000 | 8,700 | 101,000 |
| Comparative Example 4 | 7.5 | 8,400 | 110,000 | 8,600 | 104,000 |
| Comparative Example 5 | 7.3 | 8,600 | 47,000 | 9,100 | 45,000 |
| Comparative Example 6 | 7.4 | 8,600 | 86,000 | 9,100 | 87,000 |

{Test}

The above developers are evaluated with respect to image blurring (color density), white stripes, transfer efficiency, and fixability.

Image Blurring (Color Density).

The color density of an image is degraded since a degraded developer causes a developing roller to be filmed, or the charging malfunction disturbs image development. If the color density of cyan developer is equal to or less than 0.9, and if the color density of magenta developer is equal to or less than 0.8, each developer is evaluated as Not Good (NG). The color density is estimated using a MacBeth spectrophotometer.

White Stripes

The white stripes represent vertical white stripes which appear on an image due to developer degradation. The white stripes are visible to the naked eye, and whether they are evaluated to be satisfactory "OK" or not good "NG" is estimated with the naked eye.

Transfer Efficiency

When a transparent tape is attached to and removed from the developer developed on an organic photoconductive (OPC) unit, the developer on the transparent tape is measured using a MacBeth spectrophotometer, and the measured result is referred to as "A." The developer remained on the OPC unit after the developer is transferred to a transferring medium such as a transferring belt or a recording medium is taped with a transparent tape and measured using a MacBeth spectrophotometer, and the measured result is referred to as "B." The transfer efficiency is calculated by the following equation.

$$\text{Transfer Efficiency (\%)}=(A-B)/A*100 \quad \text{[Equation 1]}$$

The transfer efficiency is evaluated as "OK," if the result of Equation 1 is equal to or greater than 80%, the transfer efficiency is evaluated as acceptable if the result of Equation 1 is equal to or greater than 60% and less than 80%, and the transfer efficiency is evaluated as "NG" if the result of Equation 1 is less than 60%.

Fixability

The developer layer per unit area is set to about 0.8 mg/cm2, and the fixing unit is heated from 130° C. to 250° C. at a temperature increasing rate of 5° C. in order to print out a fixed image. A transparent tape is attached to the fixed image, the weight of about 50 g/cm2 is applied by reciprocating motion, and the color densities of the fixed image prior to and after the twice reciprocating motion are measured using the MacBeth spectrophotometer.

$$\text{Fixability (\%)}=(\text{initial color density}-\text{color density after a transparent tape is removed})/\text{initial color density}*100 \quad \text{[Equation 2]}$$

The fixability is evaluated as "NG" if the result of Equation 2 is equal to or less than 85%.

The hot offset is evaluated as "NG" if an area of the fixed image is contaminated by the fixing unit.

The result of the test is summarized in Table 2.

TABLE 2

| | Image Blurring | White Stripes | Transfer Efficiency | Fixability | Final Evaluation |
|---|---|---|---|---|---|
| Example 1 | OK | OK | OK | OK | OK |
| Example 2 | OK | OK | OK | Acceptable | OK |
| Comparative Example 1 | NG | OK | OK | OK | NG |
| Comparative Example 2 | OK | OK | OK | NG | NG |
| Comparative Example 3 | NG | Acceptable | OK | OK | NG |
| Comparative Example 4 | OK | OK | OK | NG | NG |
| Comparative Example 5 | NG | NG | OK | NG (hot offset) | NG |
| Comparative Example 6 | NG | NG | OK | OK | NG |

The above tests show that the image forming apparatuses using the developers prepared according to Examples 1 and 2 are excellent in reducing image degradation such as image blurring and white stripes, and the fixability of the developers is acceptable.

However, the image forming apparatuses using the developers prepared according to Comparative Examples 1 to 6 are not as satisfactory.

In Comparative Example 1, although the weight average molecular weight (Mw) of a binder resin of a dark developer is greater than that of a light developer, image blurring due to developer degradation occurs. This is because the weight average molecular weight (Mw) of the binder resin of the dark developer is equal to or less than about 50,000 Mw.

In Comparative Example 2, the weight average molecular weight (Mw) of a binder resin of a dark developer is greater than that of a light developer, and the tests of image blurring or white stripes obtain satisfactory results. However, the fixability is poor. This is because the binder resin of the dark developer has a high weight average molecular weight (Mw) of about 170,000 Mw.

In Comparative Example 3, the weight average molecular weight (Mw) of a binder resin of a dark developer is less than that of a light developer, and image degradation such as image blurring and white stripes occurs due to developer degradation.

In Comparative Example 4, the binder resin of the dark developer has a high weight average molecular weight (Mw) similarly to that of a light developer. In this case, the developer degradation is satisfactory, but the fixability is poor.

In Comparative Example 5, the binder resin of the dark developer has a low weight average molecular weight (Mw) similarly to that of a light developer. In this case, the developer degradation is poor.

In Comparative Example 6, the tests are performed using a conventional developer, and image degradation such as image blurring and white stripes occur.

The image forming apparatus according to exemplary embodiments of the present general inventive concept reduces degradation of image quality due to developer degradation, and provides high quality images.

According to the multicolor image forming apparatus according to exemplary embodiments of the present general inventive concept to form multicolor images using an electrophotographic technique, image degradation due to developer degradation does not occur and thus the image forming apparatus may be used for a longer period of time as compared to conventional image forming apparatuses.

The multicolor image forming apparatus according to exemplary embodiments of the present general inventive concept provides a method for forming an image without occurring image degradation due to toner stress.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. A multicolor image forming apparatus, comprising:

a developer image forming unit to form a developer image using a developer; and a transferring unit to transfer the formed developer image to a recording medium, wherein the developer comprises a plurality of dark developers and one or more light developers, wherein the dark developers and the light developers each comprises a binder resin having a weight average molecular weight ranging from about 50,000 Mw to about 160,000 Mw, and wherein about 50,000 Mw to about 160,000 Mw of the weight average molecular weight of the binder resin of the dark developer is larger than about 50,000 Mw to about 160,000 Mw of the weight average molecular weight of the binder resin of the light developer.

2. The apparatus of claim 1, wherein the binder resin of the dark developer has the weight average molecular weight from about 100,000 Mw to about 160,000 Mw, and the binder resin of the light developer has the weight average molecular weight from about 50,000 Mw to about 100,000 Mw.

3. The apparatus of claim 1, wherein the dark developer and the light developer each comprise a binder resin having a weight average molecular weight larger than or equal to about 5,000 Mw and equal to or less than about 10,000 Mw.

4. The apparatus of claim 1, wherein the binder resin of the developers comprises one selected from the group consisting of polystyrene resin, polyvinyltoluene resin, polyethylene resin, polypropylene resin, polyacrylate resin, polymethacrylate resin, polyester resin, and polyacrylonitrile resin, or a combination of two or more these.

5. The apparatus of claim 1, wherein if the dark developer comprises a magenta developer and a cyan developer, the light developer comprises one or more among a magenta light developer, a cyan light developer, a yellow light developer, a black light developer, a transparent developer, and a white developer.

6. A method for forming a multicolor image, comprising:

forming a developer image using a developer comprising a plurality of dark developers and one or more light developers; and transferring the formed developer image to a recording medium, wherein the dark developers and the light developers each comprise a binder resin having a weight average molecular weight from about 50,000 Mw to about 160,000 Mw, and wherein about 50,000 Mw to about 160,000 Mw of the weight average molecular weight of the binder resin of the dark developer is larger than about 50,000 Mw to about 160,000 Mw of the weight average molecular weight of the binder resin of the light developer.

7. The method of claim 6, wherein the binder resin of the dark developer has the weight average molecular weight from about 100,000 Mw to about 160,000 Mw, and the binder resin of the light developer has the weight average molecular weight from about 50,000 Mw to about 100,000 Mw.

8. The method of claim 6, wherein the dark developer and the light developer each comprises a binder resin having a weight average molecular weight equal to or larger than about 5,000 Mw and equal to or less than about 10,000 Mw.

9. The method of claim 6, wherein the binder resin of the developers comprises one selected from the group consisting of polystyrene resin, polyvinyltoluene resin, polyethylene resin, polypropylene resin, polyacrylate resin, polymethacrylate resin, polyester resin, and polyacrylonitrile resin, or a combination of two or more these.

10. The method of claim 6, wherein if the dark developer comprises a magenta developer and a cyan developer, the light developer comprises one or more among a magenta light developer, a cyan light developer, a yellow light developer, a black light developer, a transparent developer, and a white developer.

* * * * *